United States Patent [19]

Sawdai

[11] Patent Number: 4,919,756

[45] Date of Patent: Apr. 24, 1990

[54] METHOD OF AND APPARATUS FOR COMPENSATINGLY ADJUSTING DOCTOR BLADE

[75] Inventor: Albert H. Sawdai, Cincinnati, Ohio

[73] Assignee: The Procter & Gamble Company, Cincinnati, Ohio

[21] Appl. No.: 236,951

[22] Filed: Aug. 26, 1988

[51] Int. Cl.[5] ..... D21G 3/00

[52] U.S. Cl. ..... 162/111; 162/198; 162/260; 162/262; 162/281; 15/256.5; 15/256.51; 100/174; 101/425; 355/15

[58] Field of Search ..... 162/111, 198, 199, 260, 162/262, 272, 281; 15/256.5, 256.51; 101/425; 100/174; 118/652; 355/15

[56] References Cited

U.S. PATENT DOCUMENTS

| | | | |
|---|---|---|---|
| 2,323,983 | 7/1943 | Edmonson | 15/256.5 |
| 3,113,890 | 12/1963 | Johnson et al. | 15/256.51 |
| 3,128,207 | 4/1964 | Schmitt | 15/256.51 |
| 3,361,059 | 1/1968 | Klingler | 15/256.51 |
| 3,866,266 | 2/1975 | Dunlap | 15/256.51 |
| 4,633,999 | 7/1987 | Perneczky | 15/256.51 |
| 4,665,859 | 5/1987 | Dunlap et al. | 15/256.51 |
| 4,789,432 | 12/1988 | Goodnow et al. | 162/281 |

FOREIGN PATENT DOCUMENTS

| | | |
|---|---|---|
| 184135 | 6/1963 | Sweden . |

*Primary Examiner*—W. Gary Jones

*Assistant Examiner*—Christopher Upton

*Attorney, Agent, or Firm*—Thomas J. Slone; Larry L. Huston; John M. Pollaro

[57] ABSTRACT

A method of and apparatus for adjusting the impact angle of a doctor blade are provided to at least partially offset negative effects of doctor blade wear. For example and not by way of limitation, in papermaking machines for making creped tissue paper, a negative effect of progressive doctor blade wear is progressive diminution of machine-direction tensile strength of the paper, all other operating factors being constant. That is, machine-direction tensile strength of the paper is inversely related to doctor blade wear which wear is, generally speaking, directly related to operating time. This progressive lessening of the paper's machine-direction tensile strength can be at least partially offset or compensated for by adjusting the impact angle of the doctor blade. Albeit such adjusting might be effected by small manual adjustments at frequent intervals, it is preferably continually effected automatically in accordance with this invention using open or closed loop controller systems: for instance, open loop control as a function of time which function may be developed and iteratively refined through the use of empirical data; or closed loop control using a sensed property (e.g., tensile strength or burst strength) of the material being doctored as a control parameter and causing a closed loop control system to adjust the doctor blade as required to optimize the sensed property.

6 Claims, 4 Drawing Sheets

Fig. 3
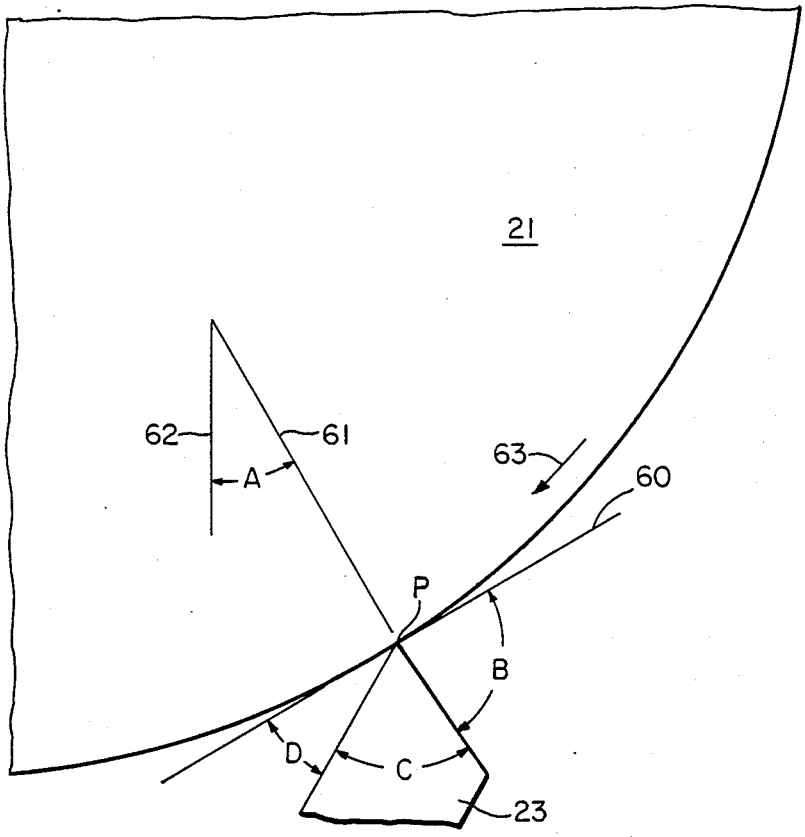
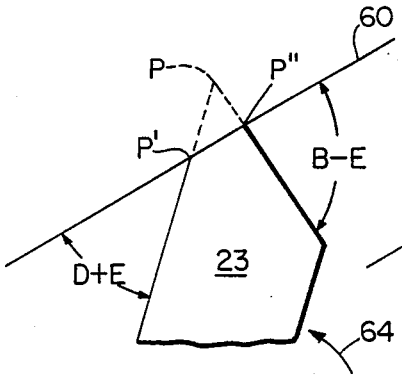
Fig. 4
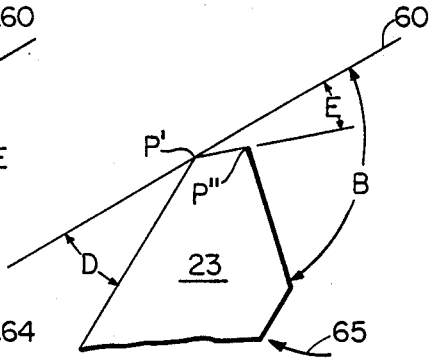
Fig. 5

MACHINE-DIRECTION TENSILE STRENGTH GRAMS/INCH WIDTH
370
360
350
340
330
320
310
300
290
72
71
PRIOR ART
0
200
400
600
800
1000
TIME AFTER DOCTOR BLADE CHANGE, MINUTES

DOCTOR BLADE HOLDER ROTATION ANGLE, DEGREES
4.0
3.5
3.0
2.5
2.0
1.5
1.0
0.5
0.0
73
0
200
400
600
800
1000
TIME AFTER DOCTOR BLADE CHANGE, MINUTES

METHOD OF AND APPARATUS FOR COMPENSATINGLY ADJUSTING DOCTOR BLADE

FIELD OF THE INVENTION

This invention pertains to apparatus which comprises one or more doctor blades, and methods of using such apparatus. This includes, for example, but is not limited to, apparatus for making creped tissue paper which apparatus may utilize doctor blades for creping per se, and/or cleaning or dressing the surface of a creping cylinder, and the like. While the invention is disclosed through describing creping doctor blades, and doctor blade wear induced reductions of tensile strength of the paper, it is not intended to thereby limit the present invention.

BACKGROUND OF THE INVENTION

Doctor blades are commonly used for effecting creping of paper in papermaking machines; and for other uses in papermaking machines, coating machines, and other machines. Inasmuch as a doctor blade is normally in contacting relation with the surface of a rotating cylinder, the tip of the doctor blade is subject to wear; and, as wear progresses, the doctor blade's effectiveness may diminish. That is, progressive wear of the doctor blade may induce progressive diminution of a particularly important property of the product being made or the material being processed by the apparatus in which the doctor blade is disposed. For example, doctor blades used for creping paper in a tissue paper making machine precipitate progressively greater loss of machine-direction tensile strength of the paper as doctor blade wear progresses. This is particularly true in installations wherein the impact angle progressively changes, as wear occurs, due to the way the doctor blade is mounted. Commonly, in such machines, creping blades are changed (i.e,, replaced by new or newly sharpened blades) after a product property of particular importance (e.g., machine direction tensile strength) has been reduced to a predetermined minimum acceptable level by doctor blade wear, or after other observed deleterious ramifications of abnormal doctor blade performance. It has been discovered, however, that the rate of progressive diminution of such an important product property due to doctor blade wear can be reduced greatly by continually adjusting the impact angle of the doctor blade. Thus, the present invention pertains, in general, to a method of and apparatus for continually adjusting the impact angle of a doctor blade to at least partially offset negative ramifications of progressive doctor blade wear: for example, so adjusting a creping doctor blade in a papermaking machine that the machine-direction tensile strength property of the paper remains more uniform over a greater period of time than were the impact angle of the doctor blade not so adjusted.

DISCLOSURE OF THE INVENTION

In accordance with one aspect of the present invention, a method is provided for reducing deleterious effects of doctor blade wear on material impacting the doctor blade in an apparatus wherein the doctor blade is so mounted that doctor blade wear progressively precipitates change in the impact angle of the doctor blade. The method comprises continually adjusting the angular position of the doctor blade to maintain a substantially constant impact angle. In another aspect of the invention, the method comprises the steps of: empirically ascertaining a time rate of change function of the impact angle of the doctor blade; and continually adjusting the angular position of the doctor blade in accordance with the determined function in order to maintain a substantially constant impact angle. Alternatively, the method may comprise the steps of: empirically ascertaining a time rate of change function of the impact angle of the doctor blade due to progressive wear of the doctor blade; empirically ascertaining the functional relation between the impact angle of the doctor blade and a physical property of material being acted on by the doctor blade which property is diminished as a result of doctor blade wear; and continually adjusting the angular position of the doctor blade in accordance with the determined functions to substantially reduce the deleterious effect on that physical property of the material which would otherwise be precipitated by doctor blade wear. The method may include continually adjusting the angular position of the doctor blade to substantially minimize the deleterious effect on the physical property of the material which would otherwise be precipitated by doctor blade wear.

In another aspect of the invention, an improved apparatus is provided which comprises means for holding and positioning a doctor blade in operative relation with an associated cylinder for the purpose of acting on material being forwarded about a sector of the cylinder, and in which apparatus progressive wear of the tip of the doctor blade precipitates progressive change of the impact angle of the doctor blade and concomitant progressive degradation of a predetermined property of said material. The improvement comprises means for automatically continually adjusting the angular position of the doctor blade to effect maintaining a substantially constant impact angle. Alternatively, the improvement may comprise means for automatically continually adjusting the angular position of the doctor blade to substantially minimize the deleterious effect on the physical property of the material which would otherwise be precipitated by doctor blade wear. In either apparatus aspect of the invention, the means for automatically continually adjusting the angular position of the doctor blade comprises means for being programmed with an empirically derived functional relation between the desired amount of doctor blade rotation and time.

BRIEF DESCRIPTIONS OF THE DRAWINGS

While the specification concludes with claims which particularly point out and distinctly claim the subject matter regarded as forming the present invention, it is believed the invention will be better understood from the following description taken in conjunction with the accompanying drawings in which:

FIG. 3 is an enlarged scale, fragmentary side elevational view of a doctor blade having its tip in contacting relation with a cylinder such as shown in FIGS. 1 and 2, and in which view the thickness of the doctor blade is greatly exaggerated relative to the radius of the cylinder.

FIG. 4 is similar to FIG. 3 but depicts the cylinder-doctor blade relation after the tip of the doctor blade has been somewhat worn, and its impact angle somewhat reduced as a result of being worn.

FIG. 5 is similar to FIG. 4 but depicts the doctor blade after it has been rotated clockwise to restore the impact angle to the value depicted in FIG. 3.

DETAILED DESCRIPTION OF THE INVENTION

Figure 1:
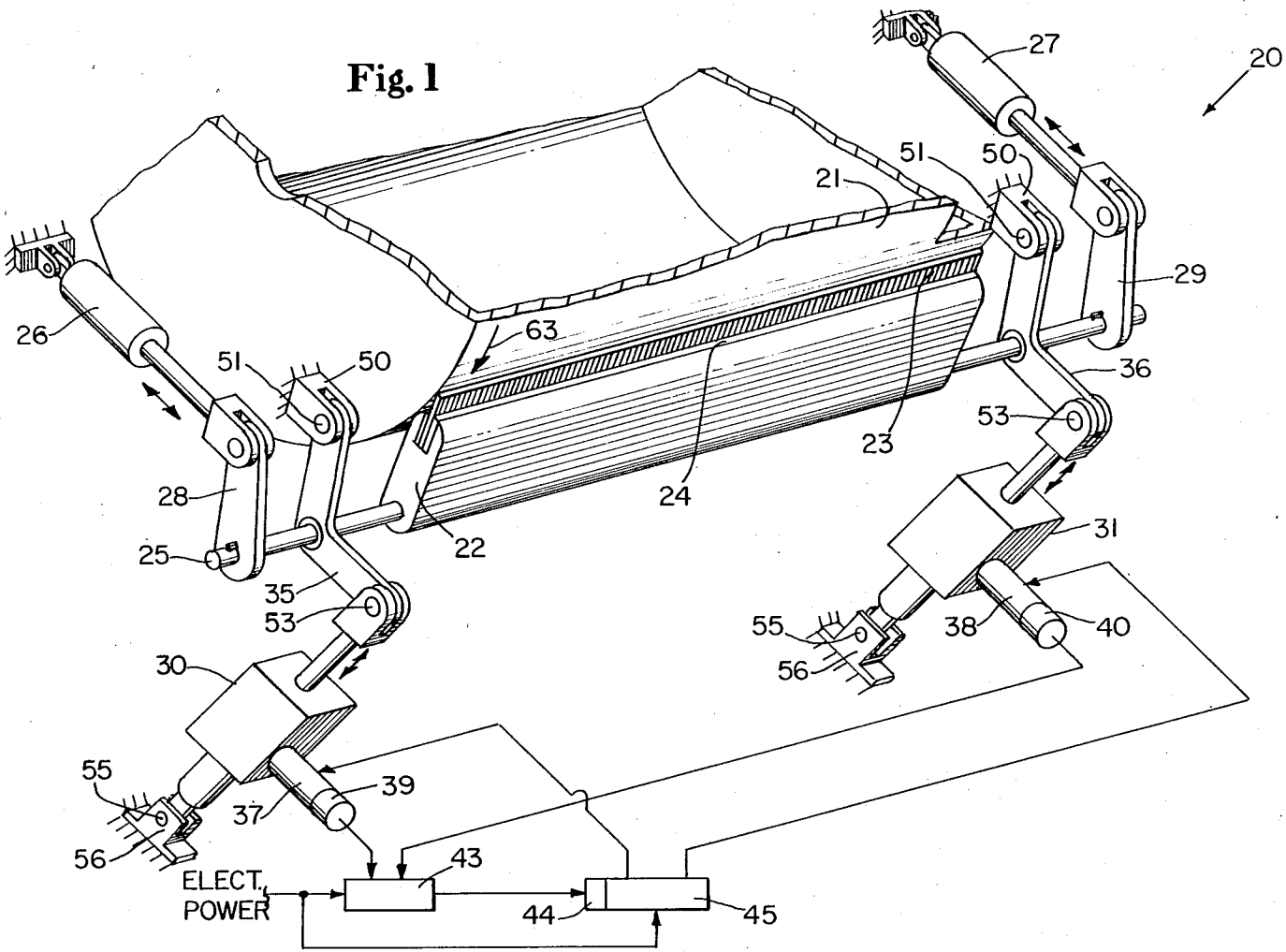
FIG. 1 is a fragmentary perspective view of a creping mechanism such as used in papermaking machines, and which mechanism incorporates means for practicing the present invention.

An exemplary creping apparatus 20 which is an embodiment of the present invention is shown in FIG. 1 to comprise a creping cylinder 21, a creping blade holder 22, a creping blade 23, creping blade biasing means 24, a shaft 25, actuator cylinders 26 and 27, tipping levers 28 and 29, motorized jackscrews 30 and 31, impact-angle-adjust levers 35 and 36, motors 37 and 38, resolvers 39 and 40, and motor control means which comprise programmable controller 43, amplifier 44, and indexer 45. Such a creping apparatus is useful in papermaking machines: particularly tissue paper making machines wherein the creping cylinder may in fact be a Yankee dryer cylinder. It is, however, not intended to thereby limit the present invention to either papermaking or creping or to apparatus comprising a Yankee dryer cylinder.

Briefly, in an apparatus comprising a doctor blade which is so mounted that its angular relation with respect to an associated cylinder changes as the tip of the doctor blade progressively wears away, the changing angular relation may cause deleterious ramifications. For example, as stated hereinbefore, the machine-direction tensile strength of creped tissue paper progressively diminishes as doctor blade wear causes the impact angle to change. The present invention provides a method of and means for lessening such deleterious ramifications by continually adjusting the doctor blade mechanism. For instance, as wear progressively results in lessening of the impact angle of the doctor blade and concomitant lessening of machine direction tensile strength of tissue paper being creped thereby, the doctor blade holder is adjusted in accordance with the present invention in the direction to increase the impact angle and thereby at least partially offset or compensate for the wear induced reduction of the impact angle.

Figure 7:
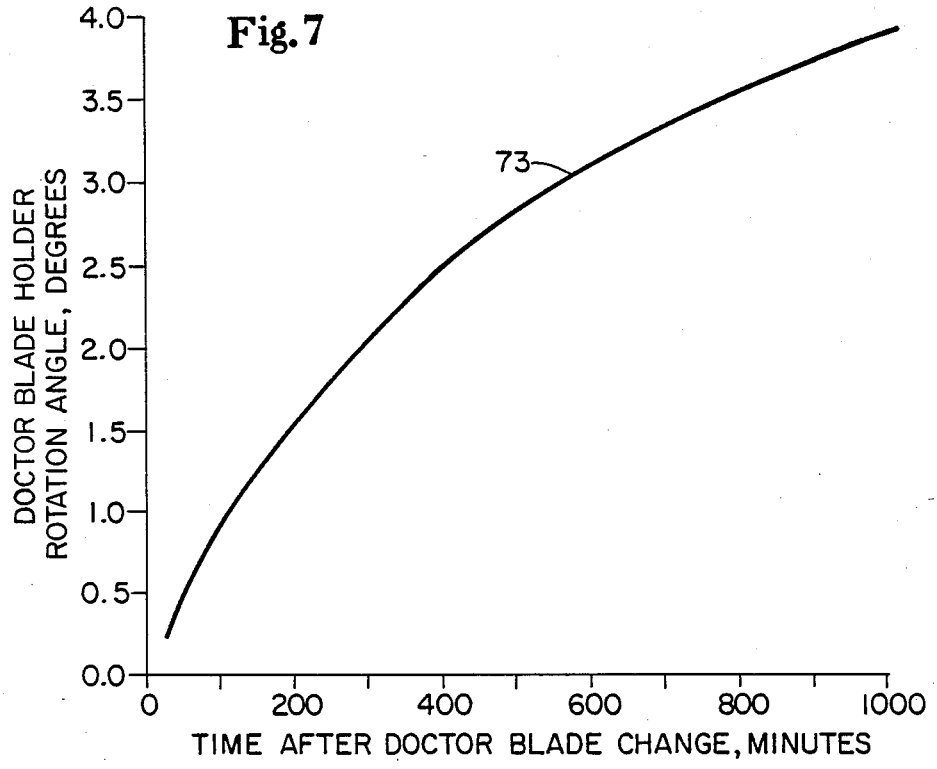
FIG. 7 is a graph of a functional relation of Doctor Blade Impact Angle Adjustment vs. Time which function may be used as a control function to practice the present invention.

In accordance with the present invention, for any given doctor blade application, a functional relation exists between the rate of adjusting the impact angle of the doctor and the benefit resulting therefrom. This functional relation may be empirically determined and iteratively improved. Then, the doctor blade adjusting mechanism may be programmed to optimally adjust the doctor blade's impact angle in accordance with the empirically determined function so that the negative effects of doctor blade wear are at least partially reduced; or, more preferably, minimized. As will be described more fully hereinafter, the rate of doctor blade tip wear reduces as wear progresses and the area of the worn land increases. Accordingly, the rate at which the doctor blade is adjusted is non-linear as exemplified by the graph shown in FIG. 7. Also, continual automatic adjustment is effected because, for example, relatively large periodic adjustments would exacerbate any tendency for the doctor blade to plug, or tear the paper, or skip, or chatter or the like.

Referring again to FIG. 1, the creping apparatus 20 is shown with the tip of the doctor blade 23 in contacting relation with the cylindrical surface of cylinder 21. In this position, the doctor blade holder is held against a mechanical stop (not shown) by actuator cylinders 26 and 27; and a portion of doctor blade 23 is cantilevered from doctor blade holder 22, and is biased against the cylinder by biasing means 24. For example, in some doctor blade holders available from Essco Incorporated, 1991 Larsen Road, P.0. Box 10297, Green Bay, Wis. 54307-0297, the biasing means are pneumatic, and the blade is held by its base so that the biasing means act to rotate the blade counterclockwise (counterclockwise as depicted in FIG. 1) about its base as the tip of the doctor blade progressively wears. As is more fully described below, doctor blade positioning means (described below) act in accordance with the present invention to rotate the doctor blade clockwise (clockwise as depicted in FIG. 1) about an axis which extends along the tip of the doctor blade. Thus, any decrease of impact angle which occurs due to doctor blade tip wear can be counteracted by the doctor blade positioning means. In accordance with the present invention, the doctor blade positioning means are controlled in such a manner that a negative effect on the product or material being doctored is lessened or minimized: for example, a reduction of tensile strength of paper being creped which is due to lessening of the impact angle (due to tip wear) can be at least partially offset by adjusting the doctor blade as described. Additionally, the rate at which the doctor blade is adjusted may be determined empirically; iteratively refined; and implemented through a programmable controller, all in accordance with the present invention.

Figure 2:
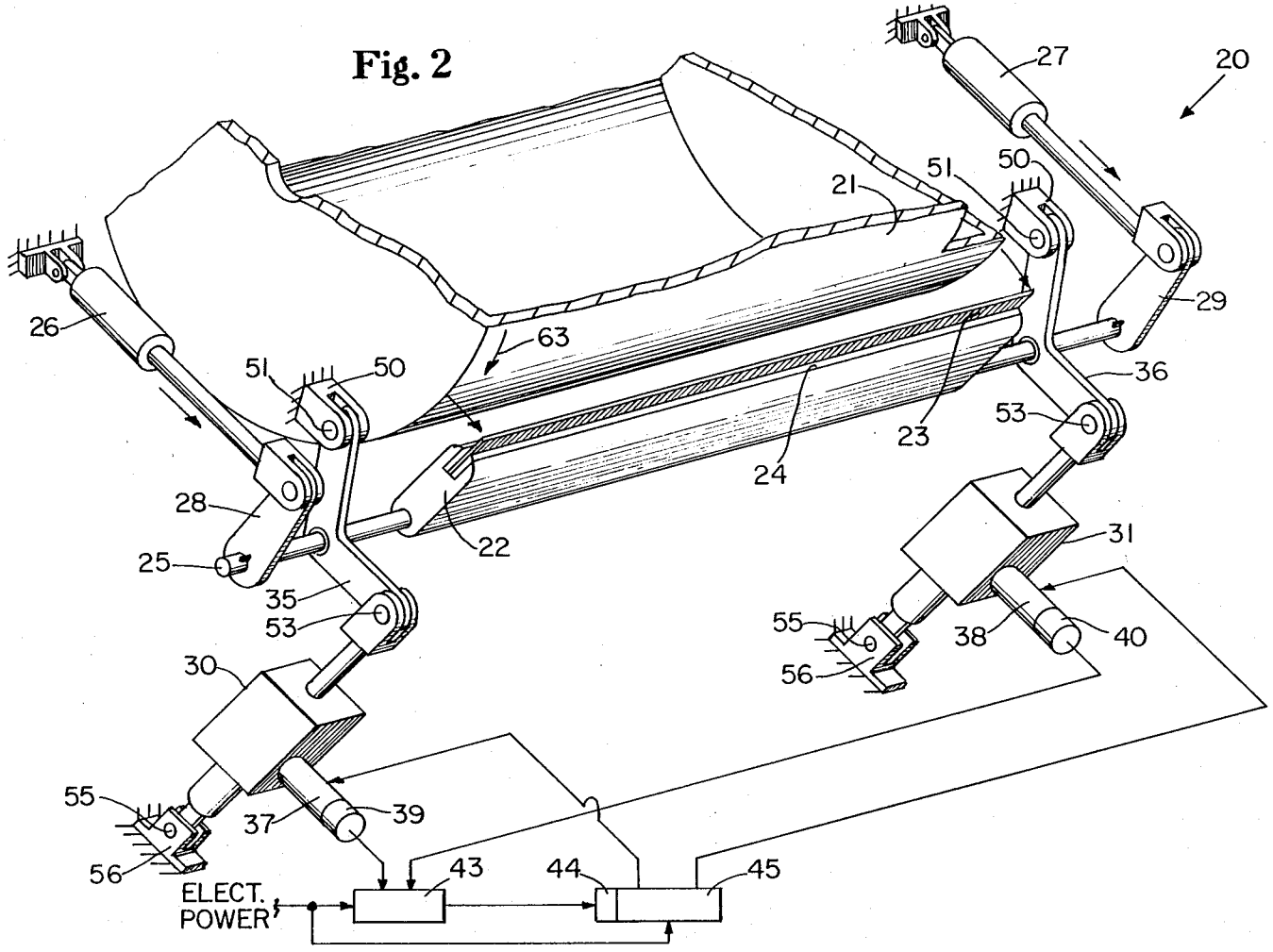
FIG. 2 is a fragmentary perspective view which is identical to FIG. 1 but for having the creping blade holder rotated to its blade-change position whereas the doctor blade per se is spaced from its associated creping cylinder.

FIG. 2 is a view of the apparatus of FIG. 1 after actuating cylinders 26 and 27 have been extended as indicated by the arrows. This action spaces the doctor blade away from the creping cylinder 21 to enable changing and adjusting the doctor blade. It is important to note that extending the actuator cylinders 26 and 27 acts through tipping levers 28 and 29 to rotate shaft 25 on which the doctor blade holder 22 is rigidly mounted. Angle-adjust levers 35 and 36 are freely rotatably mounted on shaft 25 so that rotation of shaft 25 can occur without acting to rotate or move angle-adjust levers 35 and 36.

Referring back to FIG. 1, one end of each angle-adjust lever is pivotally connected by a pivot pin 51 to a pillow block 50 which is attached to the frame of the apparatus; and the other end of each angle-adjust lever is pivotally connected by a pivot pin 53 to the free end of its respective jackscrew 30,31. The other end of each jackscrew 30,31 is pivotally secured by a pivot pin 55 to a pillow block 56 which is attached to the frame of the apparatus as shown. Thus, synchronously retracting jackscrews 30,31 causes the doctor blade holder and the doctor blade to rotate about an axis which passes through the centers of the pivot pins 51. Pillow blocks 50 are so mounted that the axis which extends through pivot pins 51 also extends along the tip of the doctor blade. Therefore, the doctor blade is in fact rotated about its tip: point P, FIG. 3. Parenthetically, some doctor blade mechanisms which are available from Essco include manual means for adjusting the jackscrews. Indeed, an exemplary embodiment of the present invention was fashioned by modifying such an Essco doctor blade mechanism by fitting the jackscrews with the motors 37,38, and adding the resolvers, controller, and indexers as shown in FIG. 1.

FIG. 3 illustrates the operative relationship between a doctor blade 23 and an associated cylinder such as shown in FIG. 1. To facilitate identification of the various angular relationships and angles, the thickness of the blade is greatly exaggerated with respect to the relative radius of the associated cylinder. For example, commonly used doctor blades which are used to effect creping of tissue paper in a papermaking machine may have a thickness of about fifty (50) thousandths of an inch (about 1.25 mm), and a Yankee dryer cylinder on which creping may be effected may be up to 15 feet (about 4.5 meters) or more in diameter. Also, tissue paper creping blades are commonly made of spring steel, and are commonly positioned so that about one to about one-and three-eights inches (from about 2.5 to about 3.5 cm) extends out of the doctor blade holder. Thus, the biasing means commonly bows this free height portion of the doctor blade. Accordingly, as the doctor blade wears, the blade progressively becomes straighter. This effect adds to the apparent counterclockwise (as viewed in FIG. 1) rotational movement of the tip of the doctor blade as wear progresses.

Still referring to FIG. 3, line 60 is tangent to cylinder 21; line 61 is a radius-line of cylinder 21 which extends through the point of contact P of the doctor blade 23; line 62 is vertical; and arrow 63 indicates the direction of rotation of cylinder 21. In a representative papermaking machine for making creped tissue paper, and effecting creping on a Yankee dryer cylinder of the machine in accordance with the present invention, angle A is about thirty (30) degrees; the impact angle B is from about eighty (80) to about ninety-five (95) degrees; the included angle C of the tip is from about sixty (60) to about seventy (70) degrees; and the set-up angle D is from about twenty-five (25) to about thirty-five (35) degrees. The surface of the doctor blade to which the impact angle B is measured is commonly called the bevel surface.

FIG. 4 depicts the tip of doctor blade 23 after the dash-line portion has been worn away, and after it has rotated counterclockwise about its base through an angle E due to the way it is mounted and biased as described hereinbefore. Thus, the impact angle has been reduced from B, FIG. 3, to (B-E) in FIG. 4; and a worn land area extends between points P′ and P″.

In FIG. 5, doctor blade 23 has been rotated through an angle E about point P′. While this could have been done by jackscrews 30,31, it is not intended to suggest that the jackscrews be operated in such a manner as to make such large step-wise adjustments. Rather, the present invention entails continually adjusting the doctor blade angle rather than making large incremental adjustments. However, for the purpose of discussion, this large adjustment restores the impact angle to B. This positions the worn land on the doctor blade tip (the portion which extends between P′ and P″) at an angle E with respect to tangent 60. This creates a wedge shape space under the leading edge P″ of the doctor blade. Were the apparatus operated in this mode, the doctor blade would not operate properly: i.e., it would be subject to plugging, skipping, or chattering, and tearing of the paper. Also, it is believed that this would likely occur if a papermachine operator were to attempt to periodically manually adjust the impact angle. To obviate these types of problems, the present invention entails continually adjusting the impact angle at such a low rate or in frequent small increments that P″ is continuously in virtual contacting relation with the surface of its associated cylinder: preferably, such continual adjusting is effected automatically through the use of a programmable controller as further described below.

Figure 6:
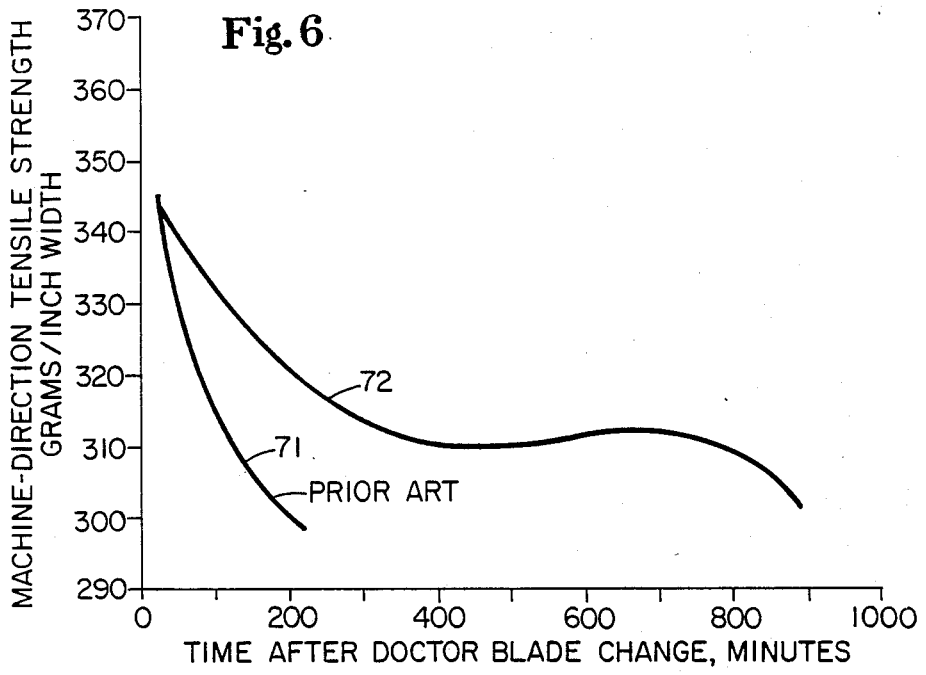
FIG. 6 is a graph of Machine-Direction Tensile Strength relative to Time for a tissue paper which has been creped through the use of a fixed doctor blade, and similar tissue paper which was creped through the use of a doctor blade which was continuously adjusted in accordance with the present invention.

Referring now to FIG. 6, curve 71 is representative of the relatively high rate of degradation of machine-direction tensile strength of tissue paper being creped by a prior art doctor blade mechanism: i.e., one that is not continually adjusted as wear progresses. Curve 72 is representative of the substantially reduced rate of degradation of machine-direction tensile strength of tissue paper that was creped through the utilization of the present invention: i.e., through continually adjusting the position of the doctor blade as delineated by curve 73, FIG. 7. In this regard, curve 73 was developed empirically for a particular papermaking machine for making a particular tissue paper. Curves 71 and 72 were derived by averaging data over extended periods of time. Accordingly, while the differences between curves 72 and 73 are believed to be qualitatively representative of the possible benefit of one application of the present invention, it is not intended to suggest or imply that a benefit of equal magnitude will be achieved by each embodiment or practice of the present invention. Rather, it is believed that each application of the present invention will require empirical development, and iterative improvement of the best doctor blade control function for use in programming the doctor blade rotating mechanism: e.g., controller 43, FIG. 1.

In operation of the creping apparatus 20, FIG. 2 illustrates the position of the mechanism immediately after a new or newly resharpened doctor blade has been installed in the doctor blade holder. Prior to moving the doctor blade into contacting relation with creping cylinder 21 (by retracting actuator cylinders 26,27), the programmable controller will have been programmed to drive the jackscrews to implement the desired control curve (e.g., curve 73, FIG. 7); and the jackscrews will have been driven to their nominal start positions (i.e., to set the doctor blade at its starting impact angle position). The operator then causes the actuator cylinders to move the doctor blade into contacting relation with the creping cylinder: the position illustrated in FIG. 1. Simultaneously, the programmable controller is caused to begin to signal the jackscrews to follow the empirically derived control curve (e.g., curve 73, FIG. 7). The operator then monitors the operation of the papermaking machine and the doctor blade apparatus; and periodically checks the value of the product property of interest. For example, the machine-direction tensile strength of the paper. This is typically checked at the end of each roll of paper as it is completed. When the value of the parameter of interest falls to a predetermined level, the operator will initiate a doctor blade change by causing the actuator cylinders to extend: to position the blade away from the creping cylinder as shown in FIG. 2.

Referring again to FIG. 1, the control system for the jackscrews functions as follows: the desired doctor blade control function (degrees of rotation vs time) is programmed into controller 43; the controller 43 compares the desired positional information (i.e., the control curve values) with actual positional information received from the resolvers 39 and 40; when the values are different, controller 43 sends drive command signals to amplifier and then through indexer 45 to motors 37 and 38; and the motors respond by rotating to the desired (programmed) position. Thus, as the programmed rotational angle increases, the motors are caused to continually drive the jackscrews to the advancing angular position; and the control continually senses this by the feedback signals from the motor mounted resolvers.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of this invention.

What is claimed is:

1. A method of reducing deleterious effects of doctor blade wear on material impacting the doctor blade in an apparatus wherein the doctor blade is so mounted that doctor blade wear progressively precipitates change in the impact angle of the doctor blade and a directly related change in a physical property of said material, said method comprising the steps of:

a. empirically ascertaining a time rate of change function of said impact angle of said doctor blade due to progressive wear of said doctor blade;

b. empirically ascertaining the functional relation between said impact angle of said doctor blade and said physical property of said material; and c. continually adjusting the angular position of the doctor blade in accordance with said function and said functional relation to substantially reduce the deleterious effect on said physical property of said material which would otherwise be precipitated by doctor blade wear.

2. The method of claim 1 wherein the step of continually adjusting the angular position of the doctor blade is effected to substantially minimize the deleterious effect on said physical property of said material which would otherwise be precipitated by doctor blade wear.

3. In an apparatus comprising means for holding and positioning a doctor blade in operative relation with an associated cylinder for the purpose of acting on material being forwarded about a sector of the cylinder, and in which apparatus progressive wear of the tip of the doctor blade over a period of time precipitates progressive time rate of change of the impact angle of the doctor blade and concomitant progressive degradation of a predetermined property of said material, the improvement comprising a means for ascertaining and comparing actual and desired doctor blade positional information, a means for sending a command signal based on the actual and desired positional information to said holding and positioning means, and means for automatically continually adjusting the angular position of the doctor blade to effect maintaining a substantially constant impact angle in response to said command signal.

4. In an apparatus comprising means for holding and positioning a doctor blade in operative relation with an associated cylinder for the purpose of acting on material being forwarded about a sector of the cylinder, and in which apparatus progressive wear of the tip of the doctor blade over a period of time precipitates progressive time rate of change of the impact angle of the doctor blade and concomitant progressive degradation of a predetermined property of said material, the improvement comprising a means for ascertaining and comparing actual and desired doctor blade positional information, a means for sending a command signal based on the actual and desired positional information to said holding and positioning means, and means for automatically continually adjusting the angular position of the doctor blade to substantially minimize the deleterious effect on said physical property of said material which would otherwise be precipitated by doctor blade wear.

5. The apparatus of claim 3 or 4 wherein said means for automatically continually adjusting the angular position of the doctor blade comprises means for being programmed with an empirically derived functional relation between the desired amount of doctor blade rotation vs. time.

6. The apparatus of claim 3 or 4 wherein said means for comparing the actual and desired doctor blade positional information comprises a feedback signal of the position of said holding and positioning means to a programmable controller.

* * * * *

UNITED STATES PATENT AND TRADEMARK OFFICE

CERTIFICATE OF CORRECTION

PATENT NO. : 4,919,756

DATED : April 24, 1990

INVENTOR(S) : Albert H. Sawdai

It is certified that error appears in the above-identified patent and that said Letters Patent is hereby corrected as shown below:

Column 3, line 62, after "doctor" insert --blade--.

Column 7, line 9, after "amplifier" insert --44--.

Signed and Sealed this

Seventeenth Day of March, 1992

*Attest:*

HARRY F. MANBECK, JR.

*Attesting Officer*

*Commissioner of Patents and Trademarks*